United States Patent [19]

Andrews et al.

[11] Patent Number: 4,488,878

[45] Date of Patent: Dec. 18, 1984

[54] PROCESS TO PRODUCE DURABLE PRESS LOW FORMALDEHYDE RELEASE CELLULOSIC TEXTILES

[75] Inventors: Bethlehem K. Andrews; Robert M. Reinhardt, both of New Orleans, La.

[73] Assignee: The United States of America as represented by the Secretary of Agriculture, Washington, D.C.

[21] Appl. No.: 586,618

[22] Filed: Mar. 6, 1984

[51] Int. Cl.[3] ..... D06M 13/40

[52] U.S. Cl. ..... 8/187; 560/158

[58] Field of Search ..... 8/187

[56] References Cited

U.S. PATENT DOCUMENTS

| | | | |
|---|---|---|---|
| 3,556,713 | 1/1971 | Kullman et al. | 8/187 |
| 3,597,380 | 8/1971 | Bertini et al. | 524/843 |
| 3,723,377 | 3/1973 | Spangler | 523/102 |
| 3,749,751 | 7/1973 | Pai | 560/160 |

OTHER PUBLICATIONS

Reid, J. D. et al., "American Dyestuff Reporter" 59 (5) 26, Jun. (1970).

Frick, J. G. Jr., at et al., "American Dyestuff Reporter" 56 (9) 41, Apr. (1967).

Wayland, R. L. et al., "Textile Research Journal" 51 (4) 302, Apr. (1981).

*Primary Examiner*—Maria Parrish Tungol

*Attorney, Agent, or Firm*—M. Howard Silverstein; David G. McConnell; Raymond C. Von Bodungen

[57] ABSTRACT

Hydroxymethylated organic carbamates are reacted with water soluble alcohols to produce etherified hydroxymethylated carbamates which are used with an acid catalyst to treat cellulosic textiles for sufficient time and temperature to produce a durable press low formaldehyde release cellulosic textile. Carbamates from the group consisting of alkyl or alkoxyalkyl carbamates of less than six carbons can be used. Water soluble aliphatic monohydric and polyhydric alcohols of one to six carbons are also satisfactory. The hydroxymethylated carbamate is reacted with the alcohol at about 10° C. to 100° C. about 0.5 to 16 hours at a pH from about 1 to 6. Concentrations of acid catalyst range from 0.5 to 3.0% of the solution. Curing temperatures range from about 120° C. to 160° C. for about 0.5 to 10 minutes.

12 Claims, No Drawings

PROCESS TO PRODUCE DURABLE PRESS LOW FORMALDEHYDE RELEASE CELLULOSIC TEXTILES

BACKGROUND OF THE INVENTION (1) Field of the Invention

This invention relates to textile finishes that have low formaldehyde release characteristics.

(2) Description of the Prior Art

Methylolated carbamate based finishing agents have long been used in the textile industry for producing durable-press fabrics that require superior white-fastness properties. The finishes are relatively resistant to acidic and basic hydrolysis conditions and therefore the finished fabrics have a more durable smooth-drying appearance than fabrics finished with traditionally used finishing agents such as: dimethyloldihydroxyethyleneurea or dimethylolethyleneurea. The major drawback to more widespread use of the methylolcarbamate based agents is the high formaldehyde release characteristics of the reagent in solution, the dried or sensitized fabric after padding, and the nonwashed, cured fabric [J. D. Reid et al in American Dyestuff Reporter 59 (5) 26, June (1970)]. Fabic that leaves from the finishing plant is not washed before shipment to the garment manufacturer, retailer, or consumer, because of economic considerations. Therefore, the workers and ultimate users of these non-washed methylolated carbamate finished fabrics may be subjected to a high level of formaldehyde release. Previously, some of these high formaldehyde release levels were lowered by reducing the ratio of formaldehyde to carbamate from greater than 2:1 to 2:1 or less in reagent preparation, and by addition of formaldehyde scavengers to the crosslinking agent solution [J. G. Frick, Jr. and R. M. Reinhardt in American Dyestuff Reporter 56 (9) 41, April (1967); U.S. Pat. No. 3,597,380; U.S. Pat. No. 3,749,751; U.S. Pat. No. 3,723,377]. These remedial measures reduced formaldehyde release in finished fabrics to a level lower than that from fabric finished with a carbamate reactant containing greater than 2 moles formaldehyde per mole of carbamate, but higher than a finish from a currently used dimethyloldihydroxyethyleneurea reactant [R. L. Wayland et al in Textile Research Journal 51 (4) 302, April (1981)].

SUMMARY OF THE INVENTION

This invention provides: (1) a process to produce cellulosic textiles with durable press properties and low formaldehyde release and the products produced in accordance with said process; (2) a process to produce new etherified hydroxymethylated carbamates which can be used to treat cellulosic textiles, which will give durable press properties and low formaldehyde release in cellulosic textiles and the products produced in accordance with said process; (3) an improved process to produce a low formaldehyde release durable press cellulosic textile of the type wherein the textile is treated with a hydroxymethylated carbamate and the products produced in accordance with said process.

The process for producing durable press low formaldehyde release cellulosic textiles comprises: reacting hydroxymethylated organic carbamates with water soluble alcohols to produce etherified hydroxymethylated carbamates and then treating a cellulosic textile with the etherified hydroxymethylated carbamates and an acid catalyst for sufficient time and at sufficient temperature to produce a durable press low formaldehyde release cellulosic textile.

The improved process used to produce a low formaldehyde release durable press cellulosic textile of the type wherein the textile is treated with a hydroxymethylated carbamate said improvement comprises: treating a cellulosic textile with an etherified carbamate agent resulting from reaction of a hydroxymethylated carbamate selected from the group consisting of alkyl or alkoxyalkyl carbamates of less than six carbons with an alcohol selected from the group consisting of water soluble aliphatic monohydric and polyhydric alcohols of one to six carbons and an acid catalyst for sufficient time and at sufficient temperature to produce a low formaldehyde release durable press cellulosic textile.

DESCRIPTION OF THE PREFERRED EMBODIMENTS

Hydroxymethylated derivatives of carbamates are well known as durable finishing agents for cellulosic textiles; therefore there is abundant literature available on preparation of these derivatives which can be used as starting materials in the process of the present invention. Included in the hydroxymethylated carbamate class of compounds are alkyl bis(hydroxymethyl)carbamates with the alkyl moiety containing one to six carbons, such as methyl, ethyl, isopropyl, n-butyl and isobutyl, and alkoxyalkyl bis(hydroxymethyl)carbamates with an alkoxyalkyl moiety such as methoxyethyl and the like. Published descriptions of these carbamates and their usefulness as textile finishing agents may be found in the review, "Carbamate Textile-Finishing Agents" published in Colourage Annual, 1971, p. 19–27. This information can be used to prepare the starting materials of the present invention.

The durable press appearance and wrinkle resistance combined with low formaldehyde release which is the subject of this invention are produced by the treatment of a cellulosic textile with the amidomethyl ether derivative of N-hydroxymethyl carbamates. The amidomethyl ether can be that of a monofunctional alcohol, such as methyl alcohol, or a polyfunctional alcohol (polyol) such as ethylene glycol, propylene glycol or sorbitol.

N-hydroxymethyl derivatives (also called methylol derivatives) of carbamates can be prepared by reaction at pH 9–100 in aqueous solution between one or more moles of formaldehyde, or a substance that liberates formaldehyde, with one mole of the carbamate at pH 9–10. Alternatively, neat hydroxymethylated carbamates (methylolated carbamates) can be prepared by a fusion method with paraformaldehyde as the source of formaldehyde (U.S. Pat. No. 3,391,181). Two moles of formaldehyde are required for each amido group of the carbamate to prepare the fully substituted compound; however, less can be used to prepare a partially methylolated compound. The lower methylol substitution causes reduced effectiveness, but may be useful in those instancces where the highest wrinkle resistance and resistance to hypochlorite bleaching are not required.

These methylol carbamate compounds can be converted to the amidomethyl ethers by reaction, in aqueous solution of one or more moles of the desired alcohol with one mole of the methylolated carbamate. This reaction is conducted at elevated temperatures at pH 2–4. However, reaction at pH 2 is preferred as products produced at this level of pH give finished fabrics with lower formaldehyde release values than products produced at higher levels of pH. At least one mole of alcohol per N-hydroxymethyl moiety is required to prepare the fully etherified compound; however, less alcohol can be used to prepare a partially etherified product. The lower etherification can be desirable where there is a loss of reactivity to cellulose from etherification. The solution thus prepared is diluted to the padding concentration after adjustment to pH 5–6.5.

In accordance with the invention, an aqueous solution is prepared as described above, containing from one to twenty percent of the reaction product containing one to two moles of the alcohol in combination with one mole of the N-hydroxymethylcarbamate. About 0.5 percent to 3 percent by weight of a catalyst, based on the total weight of the padding bath is added to the padding bath to facilitate curing. Catalysts which can be used to promote curing include mineral acids; organic acids; various salts of strong acids such as ammonium salts; alkanolamine salts; metallic salts of strong acids and weak bases, such as zinc nitrate and magnesium chloride; and combinations of the above.

The treating solution of the amidomethyl ether of the carbamate and the catalyst, prepared as described above, is padded onto the cloth by passing through efficient squeeze rolls to give a wet pickup of from about sixty to one hundred precent. Alternatively, low (or sometimes called minimum add-on) wet pickup techniques of application may be employed, such as by kiss roll, foam finishing, loop padding, spraying, printing, and other methods known in the art. The amount of wet pickup may be as low as about 20–25%, and concentration of the finishing bath ingredients are adjusted accordingly. The curing step, in which the cleavage of the ether and reaction of the hydroxymethyl derivative of the carbamate with the textile, can be carried out by conventional procedures. The padded textile is dried at an elevated temperature; for example, 60°–70° C. for seven minutes, then further heated to effect the curing. Improved properties are obtained by curing at 120°–280°, or even higher, from 0.25 to 10 minutes with time and temperature inversely adjusted. The process and compounds to which this invention relates can be used to treat any hydrophilic fibrous cellulosic textile such as cotton, linen, ramie, jute, regenerated cellulose and others, or combinations of said cellulosics with other fibers such as, for example, polyesters, nylon, acrylics, and the like.

Textiles treated according to the process of this invention are wrinkle resistant, and have smooth-drying properties; that is, textiles so treated require no ironing after washing to maintain a smooth appearance. They also exhibit the tendency to release low levels of formaldehyde, both in the unwashed and laundered state. They can be laundered in the manner used on untreated textiles without loss of properties.

The following examples are given as illustrations, and are not by any means intended to limit the scope of this invention. All percentages given in the examples are percentages by weight of the total solution. The fabrics were tested by the following methods: crease recovery angle by Monsanto method, American Society for Testing and Materials (ASTM), Standards for Textile Materials D1295-53T; Durable Press rating by American Association of Textile Chemists and Colrists Test Method 124-1980; formaldehyde release by Determination of Formaldehyde Odor in Resin Treated Fabrics (Sealed Jar Method), American Association of Textile Chemists and Colorists Test Method 112-1982. Nitrogen content was by the Kjeldahl method of analysis.

EXAMPLE 1

Preparation of methyl bis(hydroxyethoxymethyl)carbamate

Part A

To 174.2 g methyl carbamate dissolved in 40.0 g water were added 331.6 g of 36.2% formalin (120.04 g formaldehyde). The pH of the solution was adjusted to 9 with dilute sodium hydroxide. After the pH and adjustment, the temperature was raised to 60° C. and the solution heated under a reflux condenser at this temperature for 30 min. The solution was then allowed to cool 54.5% room temperature. Final solids concentration was equivalent to 54.5% methyl bis(hydroxymethyl)-carbamate.

Part B 54.5 g Reaction mixture from Part A (29.4 g solids) was adjusted with HCl at room temperature to pH 2 after addition of 13.1 g ethylene glycol. The temperature was raised to 70° C. and the mixture was heated under a reflux condenser at this temperature for 45 min. The pH was maintained at 2. The solution was allowed to cool to room temperature, and the pH was adjusted to 6. Final concentration was equivalent to 44% methyl bis(hydroxymethyl)carbamate. The reaction to the hydroxyethoxymethylated methyl carbamate was confirmed by HPLC and proton NMR analyses.

EXAMPLE 2

Preparation of methyl bis(methoxymethyl)carbamate 54.4 g Reaction mixture containing methyl bis(hydroxymethyl)carbamate (29.4 g solids) from Example 1, Part A was adjusted with dilute HCl at room temperature to pH 2, after addition of 12.8 g methyl alcohol. The temperature was raised to 70° C., and the mixture was heated under a reflux condenser at this temperarture for 45 min. The pH was maintained at 2. The solution was allowed to cool to room temperature, and the pH was adjusted to 6. Final concentration was equivalent to 43.3% methyl bis(hydroxymethyl)carbamate. The reaction to the methoxymethylated methyl carbamate was confirmed by HPLC and proton NMR analyses.

EXAMPLE 3

Preparation of isopropyl bis(hydroxyethoxymethyl)carbamate

Part A

To 103.1 g isopropyl carbamate dissolved in 57.3 g water were added 165.8 g of 36.2% formalin (60.02 g formaldehyde). The pH of the solution was adjusted to 9 with dilute sodium hydroxide. After the pH adjustment, the temperature was raised to 60° C., and the solution heated under a reflux condenser at this temperature for 30 min. The solution was then allowed to cool to room temperature. Final solids concentration of the reaction mixture was equivalent to 53% isopropyl bis(-hydroxymethyl)carbamate.

Part B 36.8 g Reaction mixture from Part A (19.5 g solids) was adjusted with HCl at room temperature to pH 2 after addition of 6.9 g ethylene glycol. The temperature was raised to 70° C. and the mixture was heated under a reflux condenser at this temperature for 45 min. The pH was maintained at 2. The solution was allowed to cool to room temperature, and the pH was adjusted to 6. Final concentration was equivalent to 44.6% isopropyl bis(hydroxymethyl)carbamate. The reaction to the hydroxyethoxymethylated isopropyl carbamate was confirmed by HPLC and proton NMR analyses.

EXAMPLE 4

Preparation of isopropyl bis(methoxymethyl)carbamate 36.8 g Reaction mixture containing isopropyl bis(hydroxymethyl)carbamate (19.5 g solids) from Example 3, Part A was adjusted with dilute HCl at room temperature to pH 2, after addition of 7.8 g methyl alcohol. The temperature was raised to 70° C., and the mixture was heated under a reflux condenser at this temperature for 45 min. The pH was maintained at 2. The solution was allowed to cool to room temperature, and the pH was adjusted to 6. Final concentration was equivalent to 39.4% isopropyl bis(hydroxymethyl)carbamate. The reaction to the methoxymethylated isopropyl carbamate was confirmed by HPLC and proton NMR analyses.

EXAMPLE 5

Preparation of isobutyl bis(hydroxyethoxymethyl)carbamate

Part A

To 117.7 g isobutyl carbamate dissolved in 20.0 g water were added 165.8 g of 36.2% formalin (60.02 g formaldehyde). The pH of the solution was adjusted to 9 with dilute sodium hydroxide. After the pH adjustment, the temperature was raised to 60° C., and the solution heated under a reflux condenser at this temperature for 30 min. The solution was then allowed to cool to room temperature. Final solids concentration of the reaction mixture was equivalent to 58.1% isobutyl bis(-hydroxymethyl)carbamate.

Part B 61.3 g Reaction mixture from Part A (35.6 g solids) was adjusted with HCl at room temperature to pH 2 after addition of 12.4 g ethylene glycol. The temperature was raised to 70° C. and the mixture was heated under a reflux condenser at this temperature for 45 min. The pH was maintained at 2. The solution was allowed to cool to room temperature, and the pH was adjusted to 6. Final concentration was equivalent to 46.9% isobutyl bis(hydroxymethyl)carbamate. The reaction to the hydroxyethoxymethylated isobutyl carbamate was confirmed by HPLC and proton NMR analyses.

EXAMPLE 6

Preparation of isobutyl bis(methoxymethyl)carbamate 61.3 g Reaction mixture containing isobutyl bis(hydroxymethyl)carbamate (35.6 g solids) from Example 5, Part A was adjusted with dilute HCl at room temperature to pH 2, after addition of 12.8 g methyl alcohol. The temperature was raised to 70° C., and the mixture was heated under a reflux condenser at this temperature for 45 min. The pH was maintained at 2. The solution was allowed to cool to room temperature, and the pH was adjusted to 6. Final concentration was equivalent to 45.1% isobutyl bis(hydroxymethyl)carbamate. The reaction to the methoxymethylated isobutyl carbamate was confirmed by HPLC and proton NMR analyses.

EXAMPLE 7

Preparation of methoxyethyl bis(hydroxyethoxymethyl)carbamate

Part A

To 119.1 g methoxyethyl carbamate dissolved in 20.0 g water were added 165.8 g of 36.2% formalin (60.02 g formaldehyde). The pH of the solution was adjusted to 9 with dilute sodium hydroxide. After the pH adjustment, the temperature was raised to 60° C., and the solution heated under a reflux condenser at this temperature for 30 min. The solution was then allowed to cool to room temperature. Final solids concentration of the reaction mixture was equivalent to 58.3% methoxyethyl bis(hydroxymethyl) carbamate.

Part B 61.4 g Reaction mixture from Part A (35.8 g solids) was adjusted with HCl at room temperature to pH 2 after addition of 12.41 g ethylene glycol. The temperature was raised to 70° C. and the mixture was heated under a reflux condenser at this temperature for 45 min. The pH was maintained at 2. The solution was allowed to cool to room temperature, and the pH was adjusted to 6. Final concentration was equivalent to 46.7% methoxyethyl bis(hydroxymethyl)carbamate.. The reaction to the hydroxyethoxymethylated methoxyethyl carbamate was confirmed by HPLC and proton NMR analyses.

EXAMPLE 8

Preparation of methoxyethyl bis(methoxymethyl)carbamate 61.4 g Reaction mixture containing methoxyethyl bis(hydroxymethyl)carbamate (35.8 g solids) from Example 7, Part A was adjusted with dilute HCl at room temperature to pH 2, after addition of 12.8 g methyl alcohol. The temperature was raised to 70° C., and the mixture was heated under a reflux condenser at this temperature for 45 min. The pH was maintained at 2. The solution was allowed to cool to room temperature, and the pH was adjusted to 6. Final concentration was equivalent to 47.4% methoxyethyl bis(hydroxymethyl)-carbamate. The reaction to the methoxymethylated methoxyethyl carbamate was confirmed by HPLC and proton NMR analyses.

EXAMPLE 9

A solution of methyl bis(hydroxyethoxymethyl)carbamate that was equivalent to 9% methyl bis(hydroxymethyl)carbamate was prepared in the following manner: 15 g final reaction solution of methyl bis(hydroxyethoxymethyl)carbamate from Example 1, Part B was diluted with 53.4 g water to give a 9% solids concentration, 2.7% by weight of an acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 1, Part A containing only 9% solids methyl bis(hydroxymethyl)carbamate, 2.7% by weight of an acidified magnesium chloride hexahydrate as catalyst, and 0.1% Triton X-100; and samples finished with the reaction solution from Example 1, Part A containing 9% solids methyl bis(hydroxymethyl)carbamate and 4% ethylene glycol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table I.

TABLE I

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| Untreated fabric | 0.02 | 1.0 | 192 | 0 | — |
| Methyl bis(hydroxyethoxymethyl)carbamate | 0.51 | 3.8 | 236 | 80 | 19 |
| Methyl bis(hydroxymethyl)carbamate | 0.70 | 4.0 | 239 | 425 | 138 |
| Methyl bis(hydroxymethyl)carbamate + ethylene glycol | 0.57 | 3.7 | 262 | 103 | 8 |

Samples of cotton printcloth were treated similarly with a final reaction solution containing methyl bis(hydroxyethoxymethyl)carbamate from Example 1 Part B except that 0.5% solids zinc nitrate hexahydrate was the catalyst used. Formaldehyde release characteristics of these fabrics were similar to those from the above treatments with the acidified magnesium chloride hexahydrate as catalyst.

EXAMPLE 10

A solution of methyl bis(methoxymethyl)carbamate that was equivalent to 9% methyl bis(hydroxymethyl)carbamate was prepared in the following manner: 14.5 g final reaction solution of methyl bis(methoxymethyl)carbamate from Example 2 was diluted with 53.5 g water, 2.7% by weight of an acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 1, Part A containing only 9% solids methyl bis(hydroxymethyl)carbamate, 2.7% by weight of an acidified magnesium chloride hexahydrate as catalyst, and 0.1% Triton X-100; and samples finished with the reaction solution from Example 1, Part A containing 9% solids methyl bis(hydroxymethyl)cabamate and 3.9% methyl alcohol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table II.

TABLE II

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| Untreated fabric | 0.02 | 1.0 | 192 | 0 | — |
| Methyl bis(methoxymethyl)carbamate | 0.60 | 4.0 | 261 | 156 | 45 |
| Methyl bis(hydroxymethyl)carbamate | 0.70 | 4.0 | 262 | 425 | 138 |
| Methyl bis(hydroxymethyl)carbamate + methyl alcohol | 0.76 | 4.5 | — | 407 | 159 |

Samples of cotton printcloth were treated similarly with a final reaction solution containing methyl bis(methoxymethyl)carbamate from Example 2 except that that 0.5% solids zinc nitrate hexahydrate was the catalyst used. Formaldehyde release characteristics of these fabrics were similar to those from the above treatments with the acidified magnesium chloride hexahydrate as catalyst.

Samples of cotton printcloth treated similarly with final reaction solutions like that from Example 2 except that the etherification. reaction with methyl alcohol was conducted at pH 3 and pH 4. Formaldehyde release from these unwashed, finished fabrics were: 223 μg/g from product prepared at pH 3; and 295 μg/g from product prepared at pH 4. This indicates that the preferred pH of the etherification reaction between a hydroxymethylated carbamate and an alcohol is pH 2.

EXAMPLE 11

A solution of isopropyl bis(hydroxyethoxymethyl)carbamate that was equivalent to 9% isopropyl bis(hydroxymethyl)carbamate was prepared in the following manner: 12 g final reaction solution of isopropyl bis(hydroxyethoxymethyl)carbamate from Example 3, Part B was diluted with 45.2 g water, 2.7% by weight of an acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 3, Part A containing only 9% solids isopropyl bis(hydroxymethyl)-carbamate, 2.7% by weight of an acidified magnesium chloride hexahydrate as catalyst, and 0.1% Triton X-100; and samples finished with the reaction solution from Example 3, Part A containing 9% solids isopropyl bis(hydroxyymethyl)carbamate and 4% ethylene glycol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table III.

TABLE III

| Finishng Agent | Durable Press Rating | Wrinkle Recovery Angle (deg)w + f | HCHO Release (μg/g) Unwashed | Washed |
|---|---|---|---|---|
| Untreated fabric | 1.0 | 192 | 0 | — |
| Isopropyl bis(hydroxyethoxymethyl)carbamate | 3.4 | 217 | 153 | 35 |
| Isopropyl bis(hydroxymethyl)carbamate | 4.3 | 258 | 577 | 113 |
| Isopropyl bis(hydroxymethyl)carbamate + ethylene glycol | 3.3 | 246 | 131 | 28 |

EXAMPLE 12

A solution of isopropyl bis(methoxymethyl)carbamate that was equivalent to 9% isopropyl bis(hydroxymethyl)carbamate was prepared in the following manner: 13.7 g final reaction solution of isopropyl bis(methoxymethyl)carbamate from Example 4 was diluted with 43.5 water, 2.7% by weight of an acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 3, Part A containing only 9% solids isopropyl bis(hydroxymethyl)carbamate, 2.7% by weight of an acidified magnesium chloride hexahydrate as catalyst, and 0.1% Triton X-100; and samples finished with the reaction solution from Example 3, Part A containing 9% solids isopropyl bis(hydroxymethyl)carbamate and 4.5% methyl alcohol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table IV.

TABLE IV

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| Untreated fabric | 0.02 | 1.0 | 192 | 0 | — |
| Isopropyl bis(methoxymethyl)carbamate | 0.48 | 4.5 | 248 | 316 | 76 |
| Isopropyl bis(hydroxymethyl)carbamate | — | 4.3 | 258 | 577 | 113 |
| Isopropyl bis(hydroxymethyl)carbamate + Methyl alcohol | 0.63 | 4.6 | 262 | 294 | 61 |

EXAMPLE 13

A solution of isobutyl bis(hydroxyethoxymethyl)carbamate that was equivalent to 9% isobutyl bis(hydroxymethyl)carbamate was prepared in the following manner: 13.4 g final reaction solution of isobutyl bis(hydroxyethoxymethyl)carbamate from Example 5, Part B was diluted with 54.8 g water, 2.7% by weight of an acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 5, Part A containing only 9% solids isobutyl bis(hydroxymethyl)carbamate, 2.7% by weight of an acidified magnesium chloride hexahydrate as catalyst, and 0.1% Triton X-100; and samples finished with the reaction solution from Example 5, Part A containing 9% solids isobutyl bis(hydroxymethyl)carbamate and 4% ethylene glycol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table V.

TABLE V

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| Untreated fabric | 0.02 | 1.0 | 192 | 0 | — |
| Isobutyl bis(hydroxyethoxymethyl)carbamate | 0.43 | 3.5 | 246 | 176 | 58 |
| Isobutyl bis(hydroxymethyl)carbamate | 0.56 | 4.0 | 261 | 528 | 71 |
| Isobutyl bis(hydroxymethyl)carbamate + ethylene glycol | 0.52 | 4.0 | 264 | 178 | 53 |

EXAMPLE 14

A solution of isobutyl bis(methoxymethyl)carbamate that was equivalent to 9% bis(hydroxymethyl)carbamate was prepared in the following manner: 14.0 g final reaction solution of isobutyl bis(methoxymethyl)carbamate from Example 6 was diluted with 54.7 g water, 2.7% by weight of an acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 5, Part A containing only 9% solids isobutyl bis(hydroxymethyl)carbamate, 2.7% by weight of an acidified magnesium chloride hexahydrate as catalyst, and 0.1% Triton X-100; and samples finished with the reaction solution from Example 5; Part A containing 9% solids isobutyl bis(hydroxymethyl)carbamate and 3.3% methyl alcohol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table VI.

EXAMPLE 15

A solution of methoxyethyl bis(hydroxyethoxymethyl)carbamate that was equivalent to 9% methoxyethyl bis(hydroxymethyl)carbamate was prepared in the following manner: 13.5 g final reaction solution of methoxyethyl bis(hydroxyethoxymethyl)carbamate from Example 7, Part B was diluted with 54.5 g water, 2.7% by weight of acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 7, Part A containing only 9% solids methoxyethyl bis(hydroxymethyl)carbamate, 2.7% by weight of an acidified magnesium chloride hexahydrate as catalyst, and 0.1% Triton X-100; and samples finished with the reaction solution from Example 7, Part A containing 9% solids methoxyethyl bis(hydroxymethyl)carbamate and 4% ethylene glycol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table

TABLE VI

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| Untreated fabric | 0.02 | 1.0 | 192 | 0 | — |
| Isobutyl bis(methoxymethyl)carbamate | 0.33 | 3.5 | 246 | 165 | 57 |
| Isobutyl bis(hydroxymethyl)carbamate | 0.56 | 4.0 | 261 | 528 | 71 |
| Isobutyl bis(hydroxymethyl)carbamate + Methyl alcohol | 0.41 | 3.8 | 247 | 528 | 75 |

VII.

TABLE VII

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| Untreated fabric | 0.02 | 1.0 | 192 | 0 | — |
| Methoxyethyl bis(hydroxyethoxymethyl)carbamate | 0.43 | 3.5 | 246 | 143 | 61 |
| Methoxyethyl bis(hydroxymethyl)carbamate | 0.59 | 4.0 | 265 | 547 | 98 |
| Methoxyethyl | 0.52 | 4.0 | 264 | 517 | 67 |

TABLE VII-continued

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| bis(hydroxymethyl)carbamate + ethylene glycol | | | | | |

EXAMPLE 16

A solution of methoxyethyl bis(methoxymethyl)carbamate that was equivalent to 9% methoxyethyl bis(hydroxymethyl)carbamate was prepared in the following manner: 13.3 g final reaction solution of methoxyethyl bis(methoxymethyl)carbamate from Example 8 was diluted with 54.7 g water, 2.7% by weight of an acidified magnesium chloride hexahydrate was added as catalyst, and 0.1% by weight of Triton X-100 was added to facilitate wetting. The treating solution was padded onto a sample of 80×80 cotton print cloth to give a 90–95% wet pickup. The wet fabric was dried at original dimensions for seven minutes at 60° C., and then cured at original dimensions for 3 minutes at 160° C. A portion of the fabric was retained for testing for formaldehyde release by the AATCC-112 test before washing. The remainder of the fabric was washed before testing. This fabric, and samples similarly finished with the reaction solution from Example 7, Part A containing only 9% solids methoxyethyl bis(hydroxymethyl)carbamate, 2.7% by weight of an acidified magnesium chloride hexahydrate as catalyst, and 0.1% Triton X-100; and samples finished with the reaction solution from Example 7, Part A containing 9% solids methoxyethyl bis(hydroxymethyl)carbamate and 3.4% methyl alcohol acidified to pH 6 with dilute HCl, 2.7% by weight of an acidified magnesium chloride hexahydrate as catalyst, and 0.1% Triton X-100 were tested for durable-press properties and formaldehyde release. The physical properties and formaldehyde release characteristics of these finishes are listed in Table VIII.

TABLE VIII

| Finishing Agent | Nitrogen Content (%) | Durable Press Rating | Wrinkle Recovery Angle (deg)w + f | HCHO Release (μg/g) Unwashed | Washed |
|---|---|---|---|---|---|
| Untreated fabric | 0.02 | 1.0 | 190 | 0 | — |
| Methoxyethyl bis(methoxymethyl)carbamate | 0.49 | 4.0 | 247 | 273 | 73 |
| Methoxyethyl bis(hydroxymethyl)carbamate | 0.56 | 4.0 | 261 | 528 | 71 |
| Methoxyethyl bis(hydroxymethyl)carbamate + Methyl alcohol | 0.54 | 4.0 | 259 | 441 | 94 |

EXAMPLE 17

The final reaction solutions from Example 1 Part A, Example 1 Part B, Example 2, Example 3 Part A, Example 3 Part B, Example 4, Example 5 Part A, Example 5 Part B, Example 6, Example 7 Part A, Example 7 Part B, and Example 8 were subjected to the AATCC 112 Test for Formaldehyde Odor (Sealed Jar Method). The results are listed in Table IX.

TABLE IX

| Finishing Agent | HCHO Release (μg/g) |
|---|---|
| Methyl bis(hydroxymethyl)carbamate | 162200 |
| Methyl bis(hydroxyethoxymethyl)carbamate | 71000 |
| Methyl bis(methoxymethyl)carbamate | 59100 |
| Isopropyl bis(hydroxymethyl)carbamate | 154200 |
| Isopropyl bis(hydroxyethoxymethyl)carbamate | 74600 |
| Isopropyl bis(methoxymethyl)carbamate | 65000 |
| Isobutyl bis(hydroxymethyl)carbamate | 107300 |
| Isobutyl bis(hydroxyethoxymethyl)carbamate | 57400 |
| Isobutyl bis(methoxymethyl)carbamate | 46200 |
| Methoxyethyl bis(hydroxymethyl)carbamate | 143900 |
| Methoxyethyl bis(hydroxyethoxymethyl)carbamate | 56000 |
| Methoxyethyl bis(methoxymethyl)carbamate | 57600 |

From the above data it can readily be seen that etherification of the hydroxymethylated carbamates with either the polyol, ethylene glycol, or with methyl alcohol occurs and that etherification produces finishing agents with formaldehyde release reduced by over 45% from that released by the bis(hydroxymethyl)carbamate itself.

EXAMPLE 18

Solutions of hydroxymethylolated isopropyl carbamates containing 50% solids of the reaction product of formaldehyde and isopropyl carbamate in molar ratios of 1:1 and 1.5:1 were prepared according to the reaction conditions specified in Example 3 Part A. Each of these solutions were diluted to a treating concentration of 9% in partially methylolated carbamate in the following manner: 18 g of the 50% solutions were diluted with 79.2 g water, 2.7 g of an acidified magnesium chloride hexahydrate was added as catalyst, and 0.1 g of Triton X-100 was added to facilitate wetting. The treating solutions were padded onto samples of 80×80 cotton print cloth to give a 90–95% wet pickup. The wet fabric was dried at original dimensions for seven minutes at 60° C., and then cured at original dimensions for 3 minutes at 160° C. A portion of these fabrics was retained for testing for formaldehyde release by the AATCC-112 test before washing. The remainder of the fabric was washed before testing. This fabric, and samples similarly finished with solutions equivalent to 9% isopropyl bis(hydroxymethyl)carbamate (Example 3 Part A), isopropyl bis(hydroxyethoxymethyl)carbamate (Example 3 Part B), isopropyl bis(methoxymethyl)carbamate (Example 4) according to the procedure specified in Examples 11 and 12 were tested for Durable Press properties, formaldehyde release and for active chlorine according to the method of Reine et al in American Dyestuff Reporter 55 (9) 91, September, 1966. The results and listed in Table X.

TABLE X

| Finishing Agent | Durable Press Rating | HCHO Release (μg/g) Unwashed | HCHO Release (μg/g) Washed | Active Chlorine (%) |
|---|---|---|---|---|
| 1:1 Formaldehyde:isopropyl carbamate | 2.5 | 180 | 52 | 0.19 |
| 1.5:1 Formaldehyde:isopropyl carbamate | 3.0 | 362 | 139 | 0.12 |
| Isopropyl bis(hydroxymethyl)carbamate | 4.5 | 577 | 113 | 0.07 |
| Isopropyl bis(hydroxyethoxymethyl)carbamate | 3.4 | 153 | 35 | 0.09 |
| Isopropyl bis(methoxymethyl)carbamate | 4.3 | 316 | 76 | 0.08 |

It can readily be seen from the above data that, although formaldehyde release can be lowered by reducing the extent of methylolation in a methylolated carbamate, it is not accomplished without loss of crosslinking efficiency. Appearance of the fabric is poor as measured by Durable Press rating, and high active chlorine content indicates susceptability of the finished fabric to scorch damage during the ironing necessitated by poor appearance.

EXAMPLE 19

A solution that was 9% in isopropyl bis(hydroxmethyl)carbamate was prepared in the following manner: 18 g of a 50% solution is isopropyl bis(hydroxymethyl)carbamate prepared according to the reaction conditions specified in Example 3 Part A were diluted with 79.2 g water, 2.7 g of an acidified magnesium chloride hexahydrate was added as catalyst, and 0.1 g of Triton X-100 was added to facilitate wetting. This solution, a solution of isopropyl bis(hydroxyethoxymethyl)carbamate that was equivalent to 9% isopropyl bis(hydroxymethyl)carbamate and 2.7% of an acidified magnesium chloride hexahydrate catalyst, prepared according to Example 11, and a solution of isopropyl bis(methoxymethyl)carbamate that was equivalent to 9% isopropyl bis(hydroxymethyl)carbamate and 2.7% of an acidified magnesium chloride hexahydrate catalyst, prepared according to Example 12, and a solution containing 9% solids dimethyloldihydroxyethyleneurea (DMDHEU, not a subject of this invention), 2.7% of an acidified magnesium chloride hexahydrate catalyst and 0.1% Triton X-100 were padded onto samples of 80×80 cotton print cloth to give a 90–95% wet pickup. The wet fabrics were dried at original dimensions for seven minutes at 60° C., and cured at original dimensions for 3 minutes at 160° C. The fabrics were washed at a neutral pH before testing for formaldehyde release before and after an alkaline aftertreatment in 2% sodium carbonate at 60° C. for 15 min. The results are in Table XI.

TABLE XI

| Finishing Agent | HCHO Release (μg/g) before $Na_2CO_3$ | HCHO Release (μg/g) after $Na_2CO_3$ |
|---|---|---|
| Dimethyloldihydroxyethyleneurea | 471 | 675 |
| Isopropyl bis(hydroxymethyl)carbamate | 113 | 47 |
| Isopropyl bis(hydroxyethoxymethyl) carbamate | 35 | 75 |

TABLE XI-continued

| Finishing Agent | HCHO Release (μg/g) before $Na_2CO_3$ | HCHO Release (μg/g) after $Na_2CO_3$ |
|---|---|---|
| Isopropyl bis(methoxymethyl)carbamate | 76 | 57 |

It is obvious from the above data that the finishes produced by the etherified hydroxymethylated carbamate derivatives of this invention enjoy the excellent resistance to alkaline hydrolysis known to be associated with cellulosic textiles finished with hydroxymethylated carbamates. This is in contrast to the poor resistance to alkaline hydrolysis of fabric finishes from dimethyloldihydroxyethyleneurea, the most widely used agent to impart durable press properties. The carbamate-based finishes are highly resistant to degradation by alkaline hydrolysis whereas the increase in formaldehyde release levels from the dimethyloldihydroxyethyleneurea finished fabric after a sodium carbonate aftertreatment indicates susceptibility of this finish to alkaline hydrolysis.

EXAMPLE 20

A solution of isopropyl bis(hydroxymethyl)carbamate was prepared according to the reaction conditions specified in Example 3 Part A. Etherified derivatives of isopropyl bis(hydroxymethyl)carbamate with other aliphatic polyhydric alcohols were prepared by reaction according to the conditions specified in Example 3 Part B with: (a) diethylene glycol; (b) 1,2-propylene glycol; (c) glycerol; and (d) sorbitol. Etherified derivatives of isopropyl bis(hydroxymethyl)carbamate with other aliphatic monohydric alcohols were prepared by reaction according to the conditions specified in Example 4 with (e) ethyl alcohol; and (f) isopropyl alcohol.

Samples of 80×80 cotton print cloth were treated with solutions of the above reaction products (a–f) that were equivalent to 9% solids bis(hydroxymethyl)carbamate and contained 2.7% solids of an acidified magnesium chloride hexahydrate as catalyst and 0.1% Triton X-100 to facilitate wetting. The fabric treatments were carried out according to the conditions specified in Example 11. Formaldehyde release characteristics of these finished fabrics before washing are as follows: (a) 85 μg/g; (b) 71 μg/g; (c) 96 μg/g; (d) 153 μg/g; (e) 268 μg/g; and (f) 176 μg/g.

We claim:

1. A process for producing durable press low formaldehyde release cellulosic textiles comprising: reacting hydroxymethylated organic carbamates with water soluble alcohols to produce etherified hydroxymethylated carbamates and then treating a cellulosic textile with the etherified hydroxymethylated carbamates and an acid catalyst for sufficient time and at sufficient temperature to produce a durable press low formaldehyde release cellulosic textiles.

2. The process of claim 1 wherein the carbamate is selected from the group consisting of alkyl or alkoxyalkyl carbamates of less than six carbons.

3. The process of claim 1 wherein the alcohol is selected from the group consisting of water soluble aliphatic monohydric and polyhydric alcohols of one to six carbons.

4. The process of claim 1 wherein the carbamate is reacted with the alcohol at about 10° C. to 100° C. for about 0.5 to 6 hours at a pH from about 1 to 6.

5. The process of claim 1 wherein the concentration of the acid catalyst is by weight about from 0.5 to 3% of the solution.

6. The process of claim 1 wherein the etherified hydroxymethylated carbamate is applied to the cellulosic textile at a pickup of about from 1 to 20%.

7. The process of claim 1 wherein the treated cellulosic textile is cured at a temperature of from about 120° C. to 160° C. for about from 0.5 to 10 minutes.

8. The process of claim 2 wherein the carbamate is selected from the group consisting of: methyl bis(hydroxymethyl)carbamate, isopropyl bis(hydroxymethyl)carbamate, isobutyl bis(hydroxymethyl)carbamate, and methoxyethyl bis(hydroxymethyl)carbamate.

9. The process of claim 3 wherein the alcohol is selected from the group consisting of: methyl alcohol, ethyl alcohol, isopropyl alcohol, ethylene glycol, diethylene glycol, 1,2-propylene glycol, glycerol, and sorbitol.

10. A durable press low formaldehyde release cellulosic textile produced in accordance with the process of claim 1.

11. An improved process to produce a low formaldehyde release durable press cellulosic textile of the type wherein the textile is treated with a hydroxymethylated carbamate, said improvement comprising: treating a cellulosic textile with an etherified carbamate agent resulting from reaction of a hydroxymethylated carbamate selected from the group consisting of an alkyl or alkoxyalkyl carbamates of less than six carbons with an alcohol selected from the group consisting of water soluble aliphatic monohydric and polyhydric alcohols of one to six carbons and an acidic catalyst for sufficient time and at sufficient temperature to produce a low formaldehyde release durable press cellulosic textile.

12. The improved durable press low formaldehyde release cellulosic textile produced in accordance with the process of claim 11.

* * * * *